US006110585A

United States Patent [19]

Shaw-Klein

[11] Patent Number: 6,110,585

[45] Date of Patent: Aug. 29, 2000

[54] INK JET RECORDING ELEMENT

[75] Inventor: Lori J. Shaw-Klein, Rochester, N.Y.

[73] Assignee: Eastman Kodak Company, Rochester, N.Y.

[21] Appl. No.: 09/218,499

[22] Filed: Dec. 22, 1998

[51] Int. Cl.[7] ..... B41M 5/00

[52] U.S. Cl. ..... 428/341; 347/105; 428/195; 428/211; 428/331; 428/342; 428/478.2; 428/480; 428/522

[58] Field of Search ..... 347/105; 428/195, 428/211, 331, 341, 342, 478.2, 480, 522

[56] References Cited

U.S. PATENT DOCUMENTS

| | | | |
|---|---|---|---|
| 5,660,928 | 8/1997 | Stokes et al. | 428/331 |
| 6,000,146 | 12/1999 | Shibahara et al. | 428/216 |

FOREIGN PATENT DOCUMENTS

| | | |
|---|---|---|
| 60 049990 | of 1985 | Japan . |
| XP002132632 | of 1997 | Japan . |

*Primary Examiner*—Bruce Hess
*Attorney, Agent, or Firm*—Harold E. Cole

[57] ABSTRACT

An ink jet recording element comprising a support having thereon the following layers:

a) a cationic mordant for an anionic dye;

b) a nonionic or amphoteric material compatible with a) and c);

c) colloidal silica; and d) a hydrophilic overcoat in an amount of at least about 0.25 g/m$^2$;

wherein either a) or c) can be directly on the support, b) is always between a) and c), and d) is the outermost layer.

17 Claims, No Drawings

INK JET RECORDING ELEMENT

FIELD OF THE INVENTION

The present invention relates to an ink jet image-recording element which yields printed images with excellent image quality, higher gloss, and fast drying.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Provide maximum printed optical densities
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light

DESCRIPTION OF RELATED ART

U.S. Pat. No. 5,660,928 relates to an ink jet receiver comprising up to five layers, one of which includes a hydrophilic silica. There is a problem with those receivers, however, in that the hydrophilic silica employed has a relatively large particle size and high internal porosity so that when an image is transferred to it, the image has low gloss and low optical density.

It is an object of this invention to provide an ink jet recording element which has a high gloss, yet is fade-resistant and does not exhibit bronzing in images transferred to it. It is another object of this invention to provide an ink jet recording element which has resistance to image bleeding but has fast dry times.

SUMMARY OF THE INVENTION

These and other objects are achieved in accordance with the invention which comprises an ink jet recording element comprising a support having thereon the following layers:

a) a cationic mordant for an anionic dye;

b) a nonionic or amphoteric material compatible with a) and c);

c) colloidal silica; and d) a hydrophilic overcoat in an amount of at least about 0.25 g/m$^2$;

wherein either a) or c) can be directly on the support, b) is always between a) and c), and d) is the outermost layer.

The ink jet recording element of the invention produces an image which has a high gloss, yet is fade-resistant and does not exhibit bronzing in images transferred to it. The transferred image is also resistant to bleeding but has fast dry times.

DETAILED DESCRIPTION OF THE INVENTION

Any mordant can be used in the above layer a) in the invention provided it produces the desired result of fixing the anionic dye transferred to it. For example, there may be used a cationic polymer, e.g., a polymeric quartenary ammonium compound, or a basic polymer, such as poly (dimethylaminoethyl)-methacrylate, polyalkylenepolyamines, and products of the condensation thereof with dicyanodiamide, amine-epichlorohydrin polycondensates; divalent Group 11 metal ions; lecithin and phospholipid compounds. Examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly (3-N,N,N-trimethyl-ammonium)propyl methacrylate chloride; a copolymer of vinylpyrrolidinone and vinyl(N-methylimidazolium chloride; and hydroxyethylcellulose derivitized with (3-N,N,N-trimethylammonium)propyl chloride. In a preferred embodiment, the cationic mordant is a quaternary ammonium compound.

The mordant used in the invention may be employed in any amount effective for the intended purpose. In general, good results are obtained when the mordant is present in an amount of from about 0.1 to about 5 g/m$^2$.

A hydrophilic material may also be included in layer a) along with the mordant. Such hydrophilic materials include naturally-occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers. In a preferred embodiment, the hydrophilic binder is gelatin.

The hydrophilic material in layer a) may be present in any amount which is effective for the intended purpose. In general, it may be present in an amount of from about 0.5 to about 20 g/m$^2$, preferably from about 1 to about 5.5 g/m$^2$, which corresponds to a dry thickness of about 0.5 to about 20 μm, preferably about 1 to about 5 μm.

If anionic colloidal silica (layer c) and cationic dye mordant (layer a) were coated in contiguous layers, incompatibility would occur at the interface, resulting in decreased gloss. Therefore, an interlayer is needed which is compatible with both cationic and anionic materials and should comprise an amphoteric or nonionic material. The nonionic or amphoteric material employed can be, for example, poly (vinyl alcohol), poly(vinyl pyrrolidone), poly(acrylamide), poly(methacrylamide), polyalkylene oxides, gelatin, their derivatives and combinations of them. In a preferred embodiment, the nonionic or amphoteric material employed is poly(vinyl alcohol) or gelatin.

In another preferred embodiment of the invention, there is an additional layer e) located beneath layer d) which also is a nonionic or amphoteric material similar to that in layer b) and which is compatible with d), and either c) or a) which is adjacent to said layer d).

The colloidal silicas useful in layer c) in the invention include, for example, the following: Nalco® 1115 (4 nm), Ludox® SM-30 (7 nm), Ludox® LS-30 (12 nm), Ludox® TM-40 (22 nm). It has been found that colloidal silica, even though its surface is anionic in nature, prevents bronzing without any negative effect on light fade. The colloidal silica may be used in any amount effective for the intended purpose. In general, good results have been obtained when the silica is present in an amount of from about 0.5 about 5 $g/m^2$, preferably from about 1 to about 3 $g/m^2$.

A hydrophilic binder material may also be present in layer c) similar to those described above in layer a), in an amount of from about 3 to about 8 $g/m^2$. In a preferred embodiment, the hydrophilic material in this layer is poly(vinyl alcohol). In another preferred embodiment, the ratio of binder to colloidal silica is from about 4:1 to 1:1. In another preferred embodiment, the colloidal silica in layer c) is coated at a coverage of about 1 to about 3 $g/m^2$. In another preferred embodiment, the colloidal silica has an anionically-charged surface and a particle size of less than about 30 nm.

The hydrophilic material used in the overcoat layer d) is similar to those described above for layer a). In a preferred embodiment, the overcoat layer comprises a cellulose ether, poly(ethylene oxide) or poly(vinyl alcohol). In another preferred embodiment, the cellulose ether comprises a mixture of a cationic cellulose ether and a nonionic cellulose ether. In another preferred embodiment, this layer is present in an amount of from about 0.25 to about 2.5 $g/m^2$.

Matte particles may be added to any or all of the layers described in order to provide enhanced printer transport, or resistance to ink offset. In addition, surfactants, defoamers, or other coatability-enhancing materials may be added as required by the coating technique chosen. Crosslinkers may also be added to the layers in order to impart improved mechanical properties or resistance to dissolution.

Another embodiment of the invention relates to an ink jet printing process comprising:

a) providing an ink jet recording element as described above, and b) applying liquid ink droplets thereon in an image-wise manner.

Any support or substrate may be used in the recording element of the invention. There may be used, for example, plain or calendered paper, paper coated with protective polyolefin layers, polymeric films such as polyethylene terephthalate, polyethylene naphthalate, poly 1,4-cyclohexane dimethylene terephthalate, polyvinyl chloride, polyimide, polycarbonate, polystyrene, or cellulose esters. In a preferred embodiment of the invention, support materials should be selected such that they permit a glossy finish capable of rendering a photographic quality print. In particular, polyethylene-coated paper or poly(ethylene terephthalate) is preferred.

The support is suitably of a thickness of from about 50 to about 500 μm, preferably from about 75 to 300 μm. Antioxidants, antistatic agents, plasticizers and other known additives may be incorporated into the support, if desired.

In order to improve the adhesion of the image-recording layer to the support, the surface of the support may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface the support to increase adhesion of the solvent-absorbing layer. If a subbing layer is used, it should have a thickness (i.e., a dry coat thickness) of less than about 2 μm.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like. Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 μm. Typical binders used in the backing layer are polymers such as acrylates, gelatin, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder.

While not necessary, the hydrophilic film forming binders described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, polyvalent metal cations, and the like may be used. If a crosslinker is added, care must be taken that excessive amounts are not used as this will decrease the swellability of the layer, reducing the drying rate of the printed areas.

The hydrophilic layers used in the recording element of the invention can also contain various known additives, including matting agents such as titanium dioxide, zinc oxide, silica and polymeric beads such as crosslinked poly (methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV-absorbing agents; mildew-proofing agents; mordants; antistatic agents, anti-oxidants, optical brighteners, and the like. Such additives can be selected from known compounds or materials in accordance with the objects to be achieved.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published Dec. 1989, pages 1007 to 1008. Slide coating is preferred, in which the base layers and overcoat may be simultaneously applied. After coating, the layers are generally dried by simple evaporation, which may be accelerated by known techniques such as convection heating.

In order to obtain adequate coatability, additives known to those familiar with such art such as surfactants, defoamers, alcohol and the like may be used. A common level for coating aids is 0.01 to 0.30 per cent active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water- soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

In the following examples, the following layers are coated directly from aqueous solutions on corona-discharge treated resin coated paper. In some cases, the layers are coated in sets of one or two layers at a time, chill set at 4.4° C., and dried by forced air heating. In other cases, the entire multilayer structure is coated simultaneously, chill set, and dried thoroughly.

Example 1

Receiver Element 1

A support of resin-coated photographic paper base was coated with:

1) pigskin photographic grade non-deionized gelatin (SBI Co.) and a mordant of a copolymer of polyvinyl benzyl trimethyl ammonium chloride and ethylene glycol dimethacrylate in a molar ratio of 93:7, in a ratio of 90:10 by weight;
2) pigskin photographic grade non-deionized gelatin;
3) poly(vinyl alcohol), Elvanol® 52/22 (DuPont Corp.) and colloidal silica, particle size 4 nm, Nalco® 1115 (Nalco Co.) in a ratio of 70:30 by weight;
4) poly(vinyl alcohol), Elvanol® 52/22; and
5) a combination of methyl cellulose, Methocel® A4M (DuPont Corp.) and cationically-modified hydroxyethyl cellulose, Quatrisoft® LM-200 (Amerchol Co.) in a weight ratio of 80:20.

Receiver Element 2

This element is the same as Receiver Element 1 except that layer 4 was omitted.

Control Receiver Element 1

This element is the same as Receiver Element 2 except that layer 2 was omitted.

In each case, layers 1 and 2 were coated from 10% solids; layer 3 from 6% solids, layer 4 from 2% solids, and layer 5 from 1.25% solids, all in water. The coating composition of layer 5 contained 0.04 weight % of surfactants 10G (Dixie Chemical) and Zonyl® FS300 (DuPont Corp.) to aid coatability. The coatings were made by the two-slide hopper technique, and were chill set and dried thoroughly between each coating pass.

TABLE 1

| Receiver | Dry Coverage of Layer ($g/m^2$) | | | | | |
|---|---|---|---|---|---|---|
| Element | 1 | 2 | 3 | 4 | 5 | Drying Conditions |
| 1 | 5.4 | 5.4 | 3.2 | 1.1 | 1.0 | 1 + 2 dried<br>3 + 4 dried<br>5 dried |
| 2 | 5.4 | 5.4 | 3.2 | Not present | 1.0 | 1 + 2 dried<br>3 + 5 dried |
| Control 1 | 5.4 | Not present | 3.2 | Not present | 1.0 | 1 dried<br>3 + 5 dried |

Gloss Test

The gloss of the above receiver elements was measured at an angle of 60 degrees to the normal of the paper surface with a Gardner Microgloss Meter.

Coalescence

Each receiver was printed using an Epson Stylus Photo 700 printer and qualitatively evaluated for degree of coalescence. Coalescence is described as local variations in optical density in a patch of solid color resulting from puddling or beading of the ink. In the case of the Epson Stylus Photo 700, such an effect is especially pronounced in areas of solid green.

TABLE 2

| Receiver Element | Gloss | Green Coalescence |
|---|---|---|
| 1 | 71 | Good |
| 2 | 71 | Poor |
| Control 1 | 49 | Poor |

The above results show that the receiver elements according to the invention have better gloss and in one case better coalescence than the control element.

Example 2

Receiver Element 3

This element was the same as Receiver Element 1 except that the coverages of the various materials are as follows: Layer 1 was 1.6 g/m$^2$; Layer 2 was 3.8 g/m$^2$ and Layer 5 was 0.75 g/m$^2$. The entire coating structure was coated simultaneously from a multiple slot hopper, chill set, and dried thoroughly. In this case, additional surfactant (10G, Dixie Chemical) was added to Layers 3 and 4 to aid in coating pack stability.

Control Receiver 2

This element is the same as Receiver Element 3 except that the cationic mordant was omitted from layer 1.

Control Receiver 3

This element is the same as Receiver Element 3 except that the colloidal silica was omitted from layer 3.

Bronzing Test

Black ink bronzing was evaluated by printing solid black patches, as well as black stripes of various widths against magenta, cyan, yellow and white backgrounds. The prints were made using an Epson Stylus Photo 700 printer at 21° C., 65% RH. Bronzing is especially apparent in thin lines, and around the edges of the solid patches. The degree of bronzing is qualitatively recorded.

Bleed Test

Resistance to bleed under high humidity storage conditions is measured by printing stripes of cyan, magenta, yellow, black, red, green and blue having a thickness of around 325 $\mu$m using the Epson Stylus Photo 700 printer. The printed samples are then incubated for one week under conditions of 21° C., 80% RH. The width of the line after incubation is recorded, and the % gain in width is computed. In order to ensure print sharpness over long storage times, low values of % line broadening are preferred.

TABLE 3

| Receiver Element | Bronzing | Bleed (% Line Broadening) | | | | | | |
|---|---|---|---|---|---|---|---|---|
| | | Cyan | Magenta | Yellow | Black | Red | Green | Blue |
| 3 | No | 0 | 17 | 0 | 8 | 5 | 3 | 2 |
| Control 2 | No | 0 | >54 | 17 | 3 | 28 | 13 | 28 |
| Control 3 | Yes | — | — | — | — | — | — | — |

The above results show that the receiver element of the invention is better than the Control 2 for bleed and better than Control 3 for bronzing.

Example 3

Receiver Element 4

This element is the same as Receiver 3 except that the dry coverage of layer 5 is 0.65 g/m$^2$.

Receiver Element 5

This element is the same as Receiver 3 except that the dry coverage of layer 5 is 0.54 g/m$^2$.

Receiver Element 6

This element is the same as Receiver 3 except that the dry coverage of layer 5 is 0.43 g/m$^2$.

Receiver Element 7

This element is the same as Receiver 3 except that the dry coverage of layer 5 is 0.32g/m$^2$.

Control Element 4

This element is the same as Receiver 3 except that the dry coverage of layer 5 is 0.22g/m$^2$.

Tackiness Test

Printed samples of each receiver were left at 21° C., 80% RH. for 4 hours. Then they were interleaved with bond paper, removed from the high humidity, and the sheets separated. Tackiness was judged qualitatively by observing the extent to which fibers from the bond paper stuck to the printed image after separation.

TABLE 4

| Receiver Element | Tackiness |
|---|---|
| 3 | Slight |
| 4 | Slight |
| 5 | Moderate |
| 6 | Moderate |
| 7 | Moderate |
| Control 4 | Severe |

The above results show th at the receiver elements of the invention have less tackiness than the control element which contained a smaller amount of overcoat material.

Example 4

Variation in layer order of the coated structure

The following example show the flexibility of the current invention as it relates to the coating order. In particular, Layers 1 and 3 can be reversed, and interlayers 2 and 4 may be changed as long as they are compatible with the layers on either side of them.

Receiver Element 8

Layer 1: 3.2 g/m$^2$ of a composition comprising a 70/30 ratio by weight of poly(vinyl alcohol) and colloidal silica;

Layer 2: 1.1 g/m$^2$ gelatin;

Layer 3: 4.3 g/m$^2$ of a composition comprising a 90/10 ratio by weight of gelatin and a polymeric cationic dye mordant;

Layer 4: 2.2 g/m$^2$ poly(vinyl alcohol);

Layer 5: 1.1 g/m$^2$ of a composition comprising an 80/20 ratio by weight of methyl cellulose and cationically modified hydroxyethyl cellulose.

The coated sample showed no bronzing and a gloss value of 73. A comparison with the examples above indicates that this change in layer order does not adversely affect performance.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon the following layers:

a) a cationic mordant for an anionic dye;

b) a nonionic or amphoteric material compatible with a) and c);

c) colloidal silica; and d) a hydrophilic overcoat in an amount of at least about 0.25 g/m$^2$;

wherein either a) or c) can be directly on said support, b) is always between a) and c), and d) is the outermost layer.

2. The recording element of claim 1 wherein a) also contains a hydrophilic binder.

3. The recording element of claim 2 wherein said hydrophilic binder is gelatin.

4. The recording element of claim 1 wherein said cationic mordant is a quaternary ammonium compound.

5. The recording element of claim 1 wherein b) is poly (vinyl alcohol) or gelatin.

6. The recording element of claim 1 wherein c) also contains a hydrophilic binder.

7. The recording element of claim 6 wherein said hydrophilic binder is poly(vinyl alcohol).

8. The recording element of claim 6 wherein the ratio of binder to colloidal silica is from about 4:1 to 1:1.

9. The recording element of claim 8 wherein said layer c) is coated at a coverage of about 2 to about 10 $g/m^2$.

10. The recording element of claim 1 wherein said colloidal silica of c) has an anionically-charged surface and a particle size of less than about 30 nm.

11. The recording element of claim 1 wherein said hydrophilic overcoat comprises a cellulose ether, poly(ethylene oxide) or poly(vinyl alcohol).

12. The recording element of claim 11 wherein said cellulose ether comprises a mixture of a cationic cellulose ether and a nonionic cellulose ether.

13. The recording element of claim 1 wherein an additional layer e) is located beneath layer d) which is a nonionic or amphoteric material compatible with d) and either c) or a) adjacent to said layer d).

14. The recording element of claim 13 wherein said layer e) is poly(vinyl alcohol) or gelatin.

15. The recording element of claim 1 wherein said support is polyethylene-coated paper or poly(ethylene terephthalate).

16. The element of claim 1 wherein said overcoat layer d) is present in an amount of from about 0.25 to about 2.5 $g/m^2$.

17. An ink jet printing process comprising:

a) providing an ink jet recording element according to claim 1, and b) applying liquid ink droplets thereon in an image-wise manner.

* * * * *